US008051793B2

(12) United States Patent
Ulgen

(10) Patent No.: US 8,051,793 B2
(45) Date of Patent: Nov. 8, 2011

(54) RETRACTABLE HYDROFOIL FOR MARINE VEHICLES

(76) Inventor: Mehmet Nevres Ulgen, Istanbul (TR)

( * ) Notice: Subject to any disclaimer, the term of this patent is extended or adjusted under 35 U.S.C. 154(b) by 449 days.

(21) Appl. No.: 12/166,469

(22) Filed: Jul. 2, 2008

(65) Prior Publication Data

US 2009/0013917 A1 Jan. 15, 2009

(51) Int. Cl.
*B63B 1/24* (2006.01)
*B63B 1/28* (2006.01)
*B63B 1/30* (2006.01)

(52) U.S. Cl. ..... 114/274; 114/280; 114/282

(58) Field of Classification Search ..... 114/274–287, 114/271

See application file for complete search history.

(56) References Cited

U.S. PATENT DOCUMENTS 2,991,747 A * 7/1961 Bader et al. ..... 114/282
3,150,626 A * 9/1964 Irgens ..... 114/282
3,763,811 A * 10/1973 Danahy ..... 114/279

* cited by examiner

*Primary Examiner* — Ajay Vasudeva
(74) *Attorney, Agent, or Firm* — Vidas, Arrett & Steinkraus P.A.

(57) ABSTRACT

A marine vehicle with at least one hydrofoil at the lower hull of such marine vehicle, and at least one drive element for retracting a pair of hydrofoils mounted side-by-side on both sides of the symmetry axis of the hull of the marine vehicle. When hydrofoils are in the retracted position, the marine vehicle is converted to a conventional marine vehicle.

3 Claims, 3 Drawing Sheets

RETRACTABLE HYDROFOIL FOR MARINE VEHICLES

FIELD OF INVENTION

The present invention relates to a retractable hydrofoil arranged at the lower hull surface contacting the water of marine vehicles, such as yachts, boats.

BACKGROUND OF INVENTION

Hydrofoils are carriage wings provided at the lower hull of marine vehicles for carrying the hull over the water so as to prevent or minimize the water contact of the underwater hull surface, resulting in a reduction of drag forces originating from the craft's water contact thereby speeding up the craft, reducing fuel consumption, and providing stable travel Conventionally, hydrofoils are statically mounted at the lower surface of hulls, meaning that hydrofoils can not be retracted that would convert such craft to a conventional craft having a flat hull i.e. without hydrofoils. The disadvantage of known marine vehicles therefore is the incapability of optionally effecting hydrofoils in a marine vehicle.

DESCRIPTION OF INVENTION

The object of the present invention is to provide retractable hydrofoils to marine vehicles so that the user of such vehicle can effect the hydrofoils as needed.

This object is achieved by a retractable hydrofoil mounted to the lower hull surface of a marine vehicle. Preferably, two hydrofoils, one to front part and one to rear part of the marine vehicle are mounted, and such retractable hydrofoils are driven by a drive mechanism for effecting the hydrofoils. When hydrofoils are in the retracted position, the marine vehicle is converted to a conventional marine vehicle.

DESCRIPTION OF FIGURES

The present invention is to be evaluated together with annexed figures briefly described hereunder to make clear the subject embodiment and the advantages thereof

REFERENCE NUMBERS OF PARTS IN FIGURES

Figure 1:
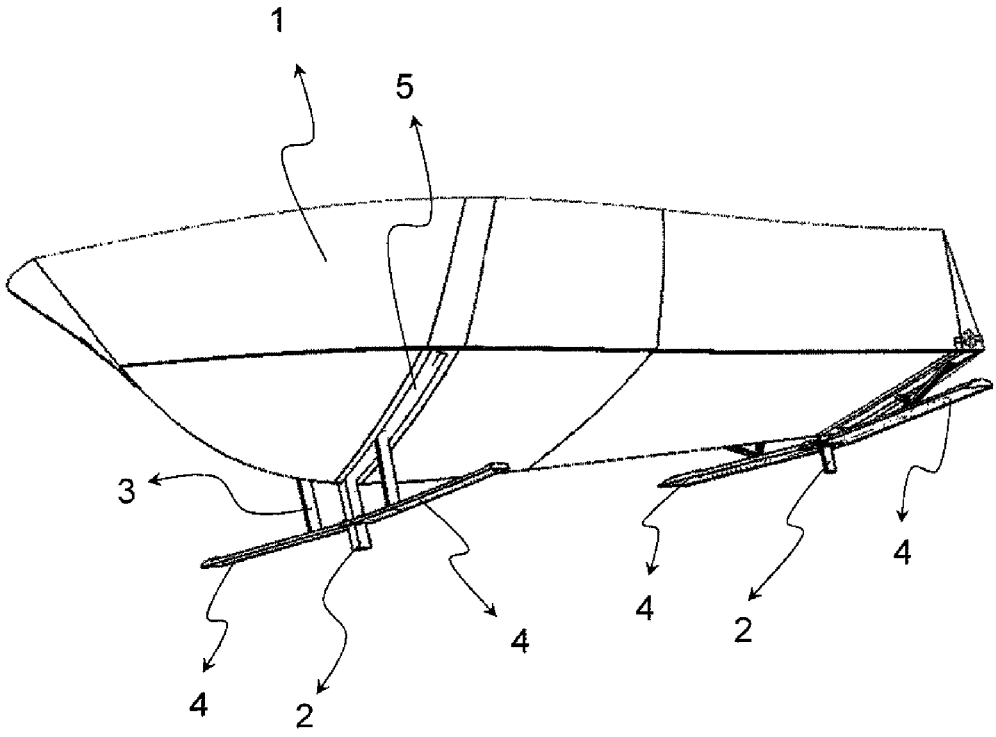
FIG. 1 illustrates hydrofoils mounted at the underwater hull of a marine vehicle.

1 Hull
2 Guide bar
3 Connecting bar
4 Hydrofoil
5 Housing
6 Piston
7 Sliding element
8 Sliding element
9 Joint
10 Hydrofoil channel
11 Housing channel
12 Joint
13 Piston
14 Sliding means

15 External surface of housing

DETAILED DESCRIPTION OF INVENTION

It should be noted that the terms "marine vehicle" and "craft" throughout this description mean any kind of marine vehicles such as boats, vessels, etc.

Figure 2:
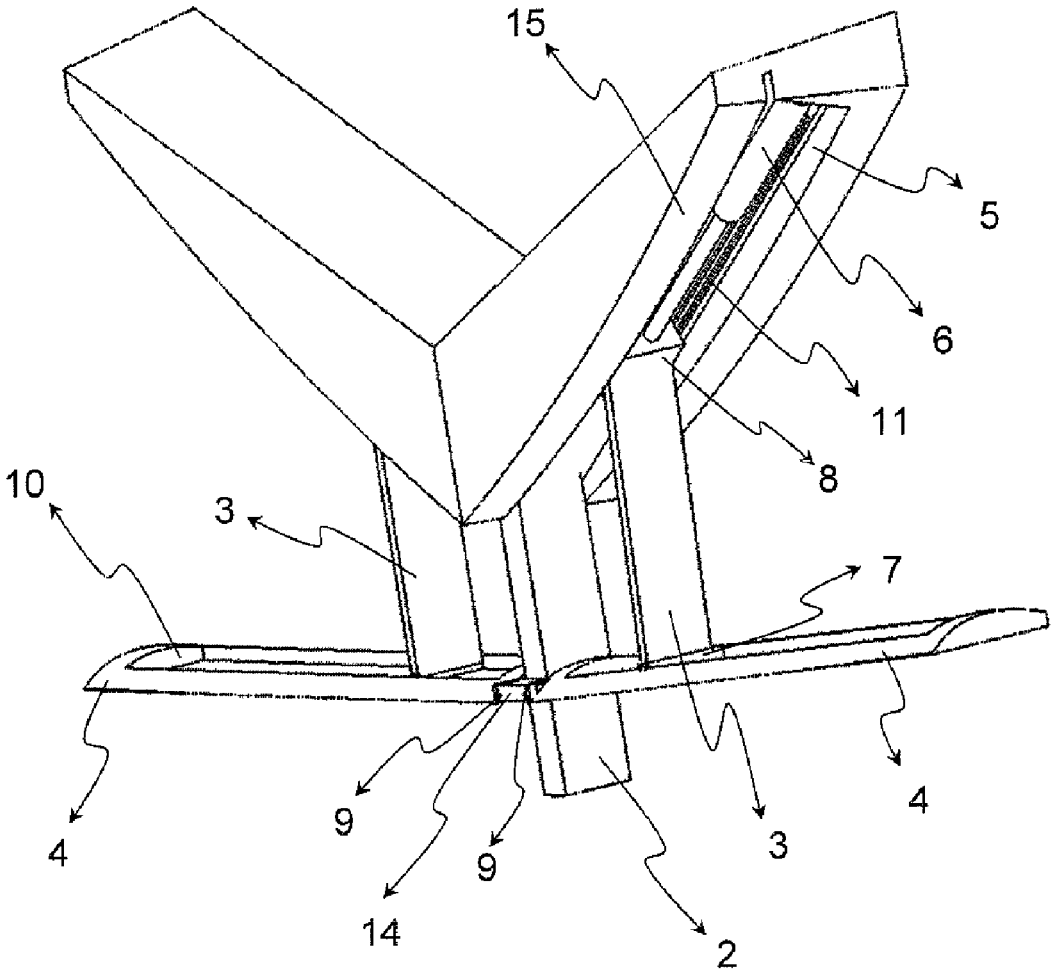
FIG. 2 illustrates hydrofoil as situated on the front part of a marine vehicle's underwater hull

As seen in FIG. 1, the retractable hydrofoils according to a preferred embodiment of the present invention are situated at the front and rear parts of the craft's underwater hull. FIG. 2 gives a detail view of the hydrofoils situated at the front According to the preferred embodiment of the invention, the hydrofoils (4) are mounted in symmetrical pairs in both sides of a vertical symmetry axis. Such side-to-side situated hydrofoils (4) are connected to a sliding means (14) by means of joints (9), this connection enables the hydrofoils to rotate with respect to said sliding means (14). The sliding means (14) is guided by a guide bar (2) fixed to the lower part of hull in a vertically-extending manner and is capable to displace vertically along this guide bar (2).

On the upper surface of said hydrofoils (4) is formed a channel (10), wherein a sliding element (7) can linearly move in the lengthwise direction of said hydrofoils (4). Furthermore, a connecting bar (3) is pivotably coupled to said sliding element (7) by means of a joint, said bar (3) being actually in an upright position with respect to the ground when the hydrofoils (4) are in extended (open) position. Since the sliding element (7) is coupled to the channel (10) within the hydrofoil (4) by means of an engageable structure as well, it is capable of transferring force to the hydrofoil (4) in the vertical direction while the hydrofoil (4) is extended and retracted.

The other end of the connecting bar (3) is connected pivotably to another sliding element (8) by means of another joint, this sliding element (8) being displaceable within a housing (5) The outer surface (15) of said housing (5) has the same surface form with the lower hull surface of the craft, when the hydrofoils are in retracted position. A channel (11) is formed within the housing (5), said sliding element (8) is able to move forward and backward in and along the channel (10).

According to the preferred embodiment of the present invention, a piston (6) is mounted in said housing channel (5) with one end of said piston (6) being connected to said sliding element (8); so, when the sliding element (8) is driven and hence the connecting bar (3) coupled to said element (8) is moved, the other sliding element (7) and thus the hydrofoil (4) connected to this sliding element (7) is brought into motion accordingly.

When the hydrofoils (4) are retracted, the underwater hull section is converted to a conventional form so that the lower surfaces of said hydrofoils (4), the outer surface of housing (15) catches surface form of the lower surface of the hull.

In an alternative embodiment of the present invention, there is also provided a piston (not illustrated in figures) extending in an axial direction in the channel (10) for driving the sliding elements (7) which displace in the hydrofoil channel (10)

Figure 3:
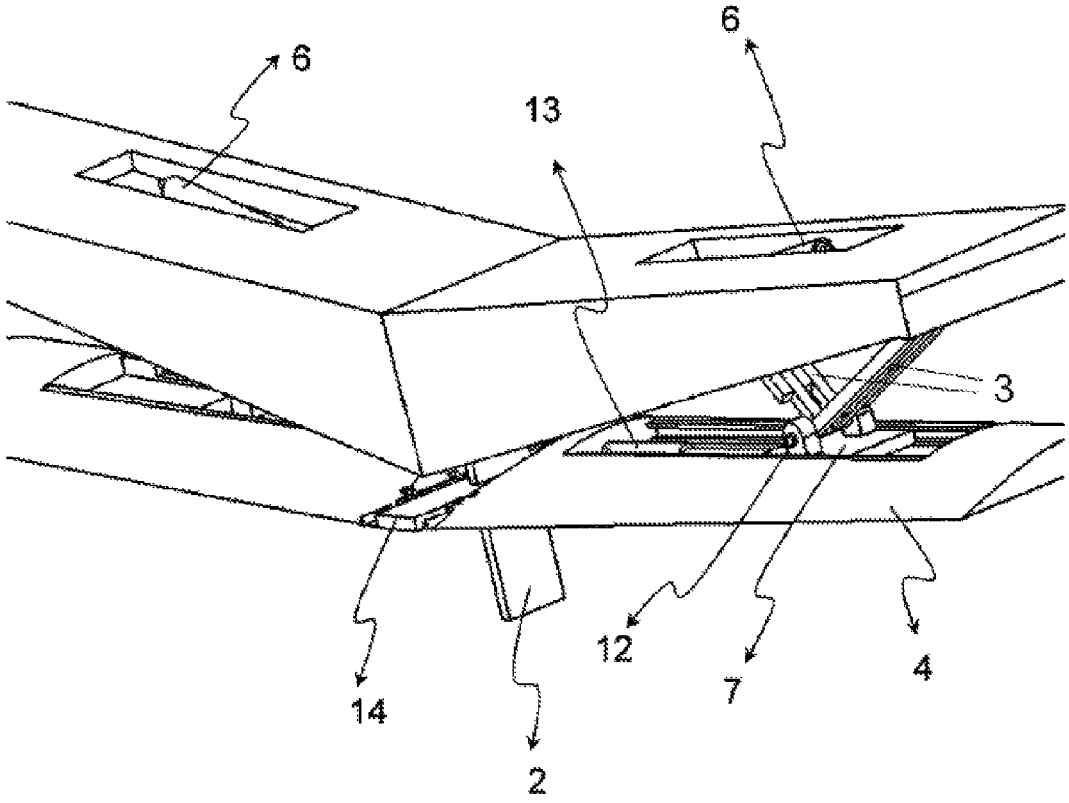
FIG. 3 illustrates hydrofoil as situated on the rear part of a marine vehicle's underwater hull.

FIG. 3 illustrates the subject hydrofoil as situated on the rear part of a marine vehicle's underwater hull. The working principle of the rear hydrofoil mechanism is basically identical to that of the front hydrofoil mechanism. The optional difference provided in the rear mechanism is that two connecting bars (3) are coupled to the sliding element (7) in the hydrofoil channel (10) by means of a joint (12), said bars (3) extending towards the terminating sections of the housing (5). Likewise, a sliding element (7) moving in said hydrofoil channel (10) can be driven in the lengthwise axis of the channel (10) by means of a piston (13) provided in the hydrofoil (4).

The invention claimed is:

1. A marine vehicle comprising;

(a) a hull;

(b) at least one pair of retractable hydrofoils provided under the hull of the marine vehicle;

(c) a guide bar for each pair of retractable hydrofoils, the guide bar extending vertically from the hull downwardly;

(d) a sliding mechanism to which each respective pair of retractable hydrofoils is connected by joints for rotating hydrofoils with respect to the sliding mechanisms, the sliding mechanisms being guided by the guide bar;

(e) connecting bars having an upper and a lower end, each connecting bar being pivotably connected at said lower end to a lower sliding element and at said upper end to an upper sliding element, said lower sliding element being linearly movable in a hydrofoil channel formed on the upper surface of each hydrofoil, and the upper sliding element being displaceable in a channel formed within a housing in said hull, the outer surface of which having the same surface form with the lower hull surface of the marine vehicle when the hydrofoils being retracted; and (f) pistons each mounted in said channel of the housing, and each piston driving other sliding elements to move the same.

2. A marine vehicle according to claim 1, comprising a further piston extending in the channel of the housing for driving the upper sliding element.

3. A marine vehicle according to claim 1, wherein said lower end of said connecting bar is connected to the lower sliding element by a joint.

* * * * *